US011672295B2

(12) United States Patent
Shaffer et al.

(10) Patent No.: US 11,672,295 B2
(45) Date of Patent: Jun. 13, 2023

(54) HELMET VENT BEZEL

(71) Applicant: Bell Sports, Inc., Scotts Valley, CA (US)

(72) Inventors: Samuel J. Shaffer, Santa Cruz, CA (US); Mark A. Busse, Santa Cruz, CA (US); Rafael T. Ramirez, Santa Clara, CA (US)

(73) Assignee: Bell Sports, Inc., Scotts Valley, CA (US)

( * ) Notice: Subject to any disclaimer, the term of this patent is extended or adjusted under 35 U.S.C. 154(b) by 255 days.

(21) Appl. No.: 17/035,449

(22) Filed: Sep. 28, 2020

(65) Prior Publication Data

US 2021/0007431 A1 Jan. 14, 2021

Related U.S. Application Data

(63) Continuation of application No. 15/638,121, filed on Jun. 29, 2017, now Pat. No. 10,786,027.

(51) Int. Cl.
*A42B 3/00* (2006.01)
*A42B 3/04* (2006.01)
(Continued)

(52) U.S. Cl.
CPC ..... *A42B 3/003* (2013.01); *A42B 3/04* (2013.01); *A42B 3/0493* (2013.01); *A42B 3/063* (2013.01);
(Continued)

(58) Field of Classification Search
CPC ..... A42B 3/283; A42B 3/04; A42B 3/281; A42B 3/28; A42B 3/0493; A42B 3/066;
(Continued)

(56) References Cited

U.S. PATENT DOCUMENTS 4,404,690 A * 9/1983 Farquharson ..... A42B 3/28 2/420
4,920,585 A 5/1990 Arai
(Continued)

FOREIGN PATENT DOCUMENTS

EP 3095342 A1 11/2016

OTHER PUBLICATIONS

Decision to grant a European patent for related European Application No. 18179749.9; dated Feb. 20, 2020.
(Continued)

*Primary Examiner* — Alissa L Hoey
*Assistant Examiner* — Patrick J. Lynch
(74) *Attorney, Agent, or Firm* — Walter M. Egbert, III; Richard J. Brown; Reed Smith LLP

(57) ABSTRACT

A helmet may include a helmet body, a fit system, a bezel, and a hardware retainer. The helmet body may have an outer shell and an energy management layer. The bezel may be separate from the outer shell and coupled to the helmet body at the vent opening of the helmet, encircle the vent opening, and have a hardware opening extending through the bezel and an anchor opening in the bezel adjacent the hardware opening. The hardware retainer may be positioned behind and coupled to the bezel. The hardware retainer may include a hardware receiving aperture aligned with the hardware opening and a hardware retainer cover coupled to a rear side of the hardware retainer. The hardware retainer may further include an anchor recess aligned with the anchor opening. The bezel may be in-molded into the energy management layer.

13 Claims, 8 Drawing Sheets

(51) Int. Cl.

| | |
|---|---|
| ***A42B 3/06*** | (2006.01) |
| ***A42B 3/28*** | (2006.01) |
| ***A42B 3/08*** | (2006.01) |
| ***A42B 3/22*** | (2006.01) |

(52) U.S. Cl.
CPC ..... *A42B 3/28* (2013.01); *A42B 3/061* (2013.01); *A42B 3/08* (2013.01); *A42B 3/22* (2013.01)

(58) Field of Classification Search
CPC .. A42B 3/30; A42B 3/003; A42B 3/08; A42B 3/22; A42B 3/063
See application file for complete search history.

(56) References Cited

U.S. PATENT DOCUMENTS

| | | | | | |
|---|---|---|---|---|---|
| 4,970,729 | A | | 11/1990 | Shimazaki | |
| 5,093,937 | A | | 3/1992 | Kamata | |
| 5,170,511 | A | * | 12/1992 | Kamata | A42B 3/283 2/424 |
| 5,309,576 | A | | 5/1994 | Broersma | |
| 5,388,278 | A | * | 2/1995 | Taniuchi | A42B 3/283 2/424 |
| 5,394,566 | A | * | 3/1995 | Hong | A42B 3/283 2/424 |
| 6,009,561 | A | | 1/2000 | Bullock et al. | |
| 6,009,562 | A | | 1/2000 | Bullock et al. | |
| 6,711,751 | B1 | | 3/2004 | Muskovitz | |
| 6,763,526 | B1 | | 7/2004 | Hong | |
| 8,495,763 | B2 | | 7/2013 | Gafforio et al. | |
| 9,675,129 | B2 | * | 6/2017 | Leedom | A42B 3/283 |
| 2004/0064873 | A1 | * | 4/2004 | Muskovitz | A42B 3/283 2/410 |
| 2004/0158914 | A1 | | 8/2004 | Tanaka | |
| 2005/0114975 | A1 | | 6/2005 | Ide et al. | |
| 2005/0278833 | A1 | | 12/2005 | Pierce | |
| 2007/0000022 | A1 | | 1/2007 | Jacobsen | |
| 2007/0011797 | A1 | | 1/2007 | Ikeda | |
| 2007/0050894 | A1 | | 3/2007 | Tsurumi | |
| 2012/0017358 | A1 | | 1/2012 | Princip et al. | |
| 2012/0180199 | A1 | | 7/2012 | Chilson et al. | |
| 2014/0189939 | A1 | | 7/2014 | Cheng | |
| 2015/0143616 | A1 | | 5/2015 | Steere | |
| 2015/0282549 | A1 | | 10/2015 | Lebel et al. | |
| 2016/0007668 | A1 | * | 1/2016 | Cech | A42B 3/04 2/422 |
| 2017/0119078 | A1 | * | 5/2017 | Chen | A42B 3/125 |
| 2017/0171372 | A1 | * | 6/2017 | Meital | H04M 1/6066 |
| 2018/0168270 | A1 | | 6/2018 | Vaccaro | |
| 2018/0310656 | A1 | * | 11/2018 | Ford | A42B 3/0453 |
| 2021/0337914 | A1 | * | 11/2021 | Rahmatyan | A42B 3/14 |

OTHER PUBLICATIONS

Notice of Allowance for related Chinese Application No. 2018106813723; dated May 26, 2021 (Chinese translation begins on p. 2).

* cited by examiner

HELMET VENT BEZEL

CROSS-REFERENCE TO RELATED APPLICATION

This application is a continuation of U.S. patent application Ser. No. 15/638,121, filed on Jun. 29, 2017, the disclosure of which is incorporated by reference in its entirety herein.

TECHNICAL FIELD

Aspects of this document relate generally to a helmet with a bezel, and more specifically to a helmet with a bezel positioned near a vent opening of the helmet.

BACKGROUND

Protective headgear and helmets have wide uses. The usable surface space on the helmet body can be crowded because it often has helmet components such as a fit system and accessories such as a visor or camera attached. The available space on a typical bicycle helmet body, however, is further reduced by vent openings distributed around the helmet body for ventilation purposes. The vent openings also weaken the strength of the vent wall around the openings. When a part is attached to the helmet near a vent opening, the vent wall often blows out from the force exerted by or through the part.

SUMMARY

According to an aspect of the disclosure, a helmet may comprise a helmet body comprising an outer shell and an energy management layer inside the outer shell, the outer shell comprising a vent opening through the outer shell and the energy management layer, a fit system disposed within the energy management layer and coupled to the helmet body, a bezel separate from the outer shell and coupled to the helmet body at the vent opening, the bezel encircling the vent opening and having a hardware opening extending through the bezel and an anchor opening in the bezel adjacent the hardware opening, and a hardware retainer positioned behind and coupled to the bezel, the hardware retainer comprising a hardware receiving aperture aligned with the hardware opening, a hardware retainer cover coupled to a rear side of the hardware retainer, and an internally threaded nut aligned with the hardware opening and configured to receive and engage an accessory connector therein, the hardware retainer further comprising an anchor recess aligned with the anchor opening, wherein the bezel is in-molded into the energy management layer.

Particular embodiments may comprise one or more of the following. The bezel may further comprise a footing extending behind the bezel. The hardware retainer may be coupled to the bezel by being snapped into the bezel. The bezel may comprise at least one prong extending rearward of the bezel adjacent the hardware opening, the hardware retainer comprises at least one prong receiver, and the hardware retainer is snapped to the bezel by the at least one prong being received into the at least one prong receiver. The accessory connector may be an accessory connector from one of a visor mechanism, a chin guard anchor, a light anchor, and an electronic accessory anchor. The hardware retainer cover may be hingedly coupled to the hardware retainer. At least one of the bezel and the hardware retainer may be configured to attach to the helmet with one or more of a strap anchor, a fit system, a comfort liner, and a multi-directional impact protection system.

According to an aspect of the disclosure, a bezel assembly for a helmet may comprise a bezel sized to encircle a vent opening of a helmet and having a hardware opening extending through the bezel and an anchor opening in the bezel adjacent the hardware opening, and a hardware retainer positioned behind and coupled to the bezel, the hardware retainer comprising a hardware receiving aperture aligned with the hardware opening and a hardware retainer cover coupled to a rear side of the hardware retainer, and the hardware retainer further comprising an anchor recess aligned with the anchor opening.

Particular embodiments may comprise one or more of the following. The bezel may further comprise a footing extending behind the bezel. The hardware retainer may be coupled to the bezel by being snapped into the bezel. The bezel may comprise at least one prong extending rearward of the bezel adjacent the hardware opening, the hardware retainer may comprise at least one prong receiver, and the hardware retainer may be snapped to the bezel by the at least one prong being received into the at least one prong receiver. The accessory connector may be an accessory connector from one of a visor mechanism, a chin guard anchor, a light anchor, and an electronic accessory anchor. At least one of the bezel and the hardware retainer may be configured to attach to the helmet with one or more of a strap anchor, a fit system, a comfort liner, and a multi-directional impact protection system.

According to an aspect of the disclosure, a helmet may comprise a helmet body comprising an outer shell and an energy management layer inside the outer shell, the outer shell comprising a vent opening through the outer shell and the energy management layer, and a bezel separate from the outer shell and coupled to the helmet body at the vent opening, the bezel encircling the vent opening and having a hardware opening extending through the bezel and an anchor opening in the bezel adjacent the hardware opening, wherein the bezel is in-molded into the energy management layer.

Particular embodiments may comprise one or more of the following. The helmet may further comprise a hardware retainer positioned behind and coupled to the bezel. The hardware retainer may comprise a hardware receiving aperture aligned with the hardware opening and a hardware retainer cover coupled to a rear side of the hardware retainer. The hardware retainer may further comprise an anchor recess aligned with the anchor opening. The bezel may further comprise a footing extending behind the bezel. The hardware retainer may be coupled to the bezel by being snapped into the bezel. The bezel may comprise at least one prong extending rearward of the bezel adjacent the hardware opening, the hardware retainer may comprise at least one prong receiver, and the hardware retainer may be snapped to the bezel by the at least one prong being received into the at least one prong receiver. The accessory connector may be an accessory connector from one of a visor mechanism, a chin guard anchor, a light anchor, and an electronic accessory anchor. The bezel may be configured to attach to the helmet with one or more of a strap anchor, a fit system, a comfort liner, and a multi-directional impact protection system.

Aspects, embodiments and applications of the disclosure presented here are described below in the drawings and detailed description. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. § 112, ¶ 6. Thus, the use of the words "function," "means" or "step" in the Detailed Description or Description of the Drawings or claims is not intended to somehow indicate a desire to invoke the special provisions of 35 U.S.C. § 112, ¶ 6, to define the invention. To the contrary, if the provisions of 35 U.S.C. § 112, ¶ 6 are sought to be invoked to define the inventions, the claims will specifically and expressly state the exact phrases "means for" or "step for", and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventors not to invoke the provisions of 35 U.S.C. § 112, ¶ 6. Moreover, even if the provisions of 35 U.S.C. § 112, ¶ 6 are invoked to define the claimed aspects, it is intended that these aspects not be limited only to the specific structure, material or acts that are described in the preferred embodiments, but in addition, include any and all structures, materials or acts that perform the claimed function as described in alternative embodiments or forms of the disclosure, or that are well known present or later-developed, equivalent structures, material or acts for performing the claimed function.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

Implementations will hereinafter be described in conjunction with the appended drawings, where like designations denote like elements, and.

DETAILED DESCRIPTION

Figure 1A:
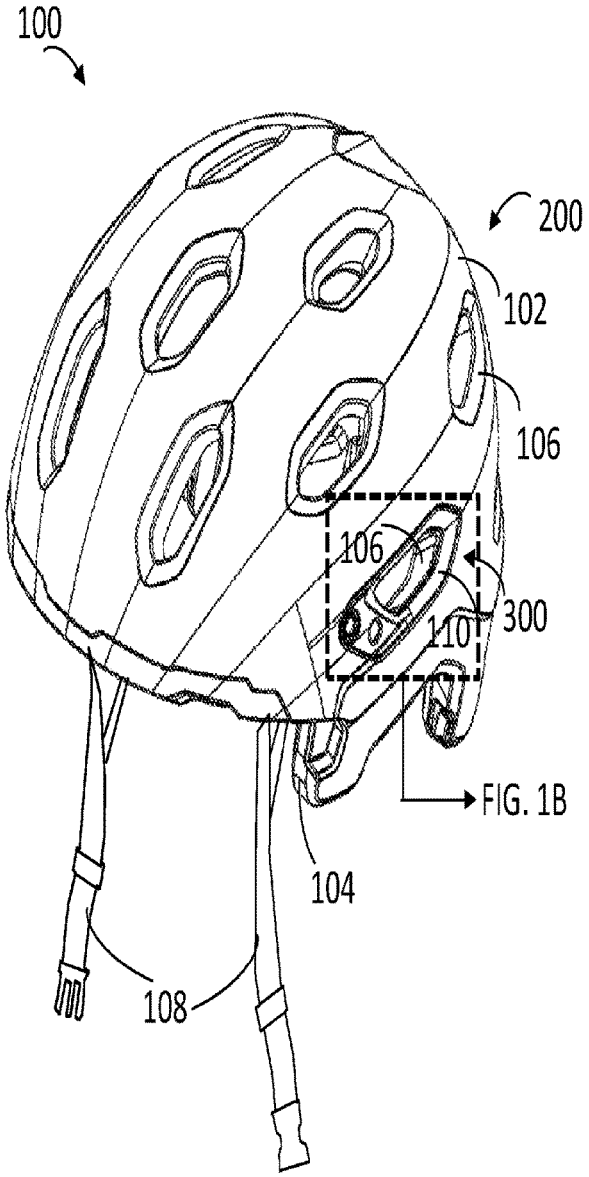
FIG. 1A is a front perspective view of a helmet included with a bezel assembly.

Protective headgear and helmets have been used in a wide variety of applications and across a number of industries, including recreation, sports, athletics, construction, mining, and military defense, to prevent damage to users' heads and brains. Damage and injury to a user can be prevented or reduced by preventing hard objects, sharp objects, or both, from directly contacting the user's head, and also by absorbing, distributing, or otherwise managing energy of an impact between the object and the user's head. Straps or webbing are typically used to allow a user to releasably wear the helmet, and to ensure the helmet remains on the user's head during an impact.

Helmets function to provide protection while minimizing interference with an activity. The shape of a helmet may be adapted to provide both protection and comfort (e.g. ventilation and size). Some helmets are made of two or more bodies of energy-absorbing material to form shapes that would be difficult, if not impossible, to achieve in a single molded piece.

Various implementations and embodiments of protective helmets according to this disclosure comprise a protective shell. The protective shell can be made of an energy absorbing material, such as expanded polystyrene (EPS), expanded polyurethane (EPU), expanded polyolefin (EPO), expanded polypropylene (EPP), or other suitable material. The energy absorbing material can be part of a hard-shell helmet such as skate bucket helmets, motorcycle helmets, snow sport helmets, football helmets, batting helmets, catcher's helmets, or hockey helmets, and include an additional outer protective shell disposed outside, or over, the protective shell. In hard shell applications, the energy absorbing material can comprise one or more layers of energy absorbing material and provide more flexibility than available with conventional in-molded helmets. Alternatively, the energy absorbing material can be part of an in-molded helmet such as bicycle helmet or cycling helmet. As an energy-absorbing layer in an in-molded helmet, the protective shell can comprise rigid materials such as EPS and EPU. An outer shell layer, such as a layer of stamped polyethylene terephthalate (PET) or a polycarbonate shell, can be included on an outer surface of the protective shell of the helmet and be bonded directly to the expanding foam (e.g. EPS as it is expanding such that the foam is molded in the shell).

Contemplated as part of this disclosure is a bezel that reinforces the vent opening of a helmet while also including a receptacle configured to receive an accessory connector therein or be used as a connector to connect other components of the helmet so that additional in-molded parts are eliminated. While needing to withstand significant impact energy, helmets have many parts that need to be in-molded. Therefore, space on the helmet is at a premium. In conventional methods of helmet construction, parts generally perform one task. Integrating components together to serve multiple purposes and reinforce each other can reduce the space problem. Bezel assembly embodiments disclosed herein integrate several structures and purposes into a single assembly, decreasing the overall stack height of the components and the number of separate components in the helmet.

Figure 1B:
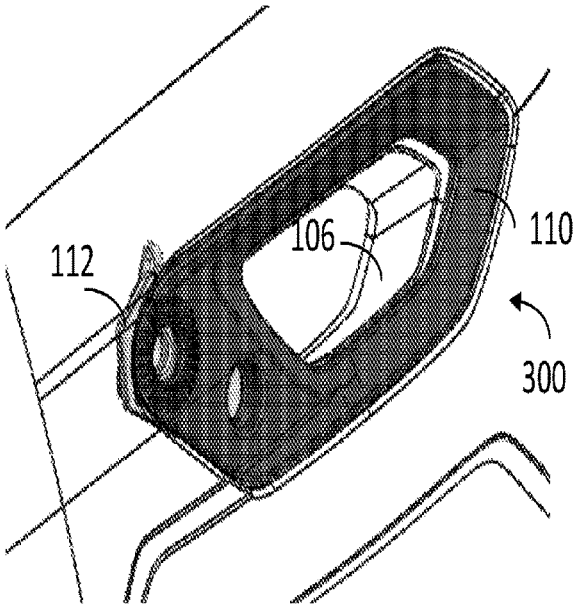
FIG. 1B is a blow-up view of the bezel assembly shown in FIG. 1A.

A helmet 100, as illustrated in FIG. 1A, may comprise a helmet body 200 and a fit system 108. In the embodiment of FIG. 1A, the helmet body 200 comprises an outer shell 102 and an energy management layer 104 inside the outer shell 102 with one or more vent openings 106 through the outer shell 102 and the energy management layer 104. The fit system 108 is disposed within the energy management layer 104 and coupled to the helmet body 200. The helmet 100 of FIG. 1A further comprises a vent bezel or bezel 110 and a hardware retainer 112 forming a bezel assembly 300. The bezel 110 is separate from the outer shell 102 and coupled to the helmet body 200 at the vent opening 106. The bezel 110 encircles the vent opening 106. The bezel assembly 300 or the bezel 110 by itself can be in-molded into the helmet body 200, such as in the energy management layer 104. For example, FIG. 1A shows the front perspective view of a helmet 100 installed with a bezel assembly 300 and with the bezel 110 encircling a vent opening 106 of the helmet 100. FIG. 1B is a blow-up view of a portion of FIG. 1A.

Figure 2A:
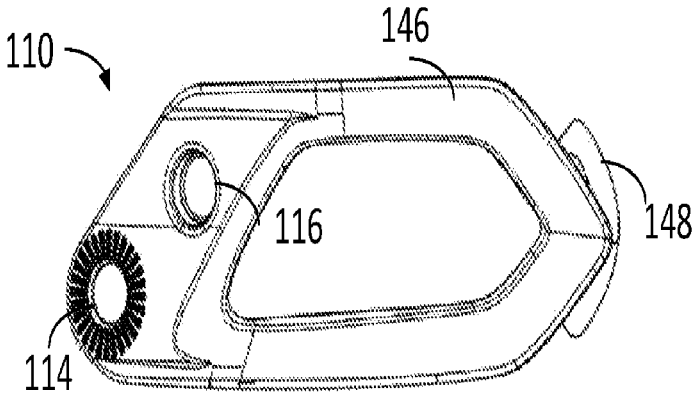
FIG. 2A is a front perspective view of a bezel.
Figure 2B:
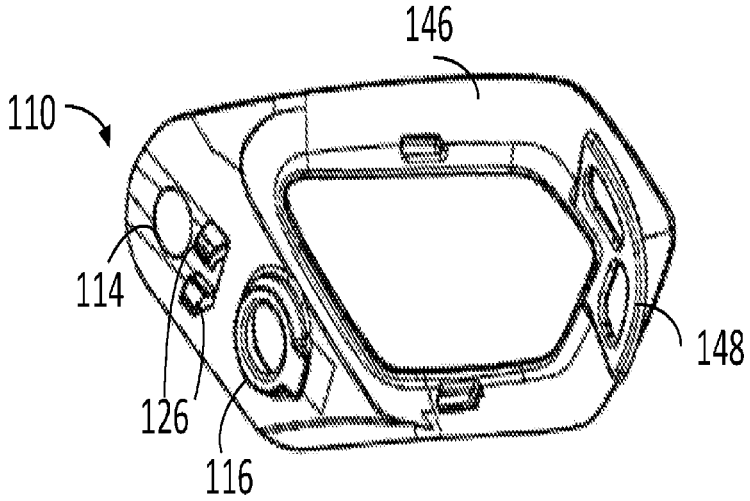
FIG. 2B is a rear perspective view of the bezel shown in FIG. 2A.

The bezel 110, as illustrated in FIG. 2A, comprises a hardware opening 114 extending through the bezel 110 and an anchor opening 116 in the bezel adjacent the hardware opening 114 (FIGS. 2A and 2B). FIG. 2A shows a front perspective view of a bezel 110 and FIG. 2B shows a rear perspective view of the bezel 110 shown in FIG. 2A. The bezel 110 includes a ring-like structure 146 so that the bezel 110 can encircle a vent opening 106. The shape of the ring-like structure may vary depending on the shape of the vent opening. A footing 148 extends behind the bezel 110. The footing 148 may be used to anchor the bezel 110 in the energy management layer 104. The footing 148 may comprise loops that allow EPS beads to flow around during the molding and anchor the bezel 110 in the energy management layer 104. The footing 148 may also be used to balance the force exerted on the bezel 110 at the hardware opening 114 and the anchor opening 116 when an accessory or a component of the helmet is attached to the helmet body through the bezel.

Figure 3C:
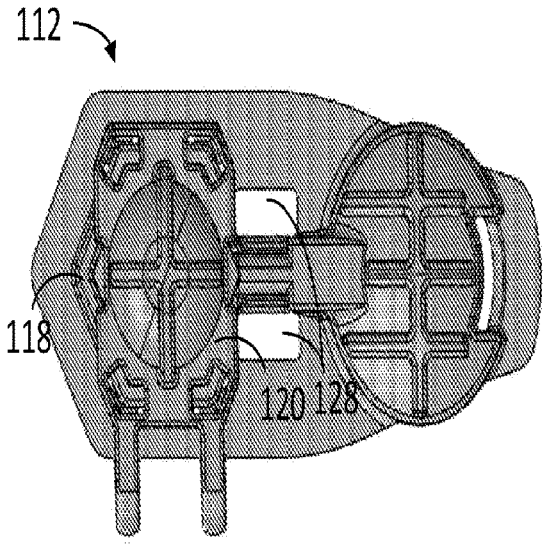
FIG. 3C is the rear view of the hardware retainer shown in FIG. 3A.
Figure 3D:
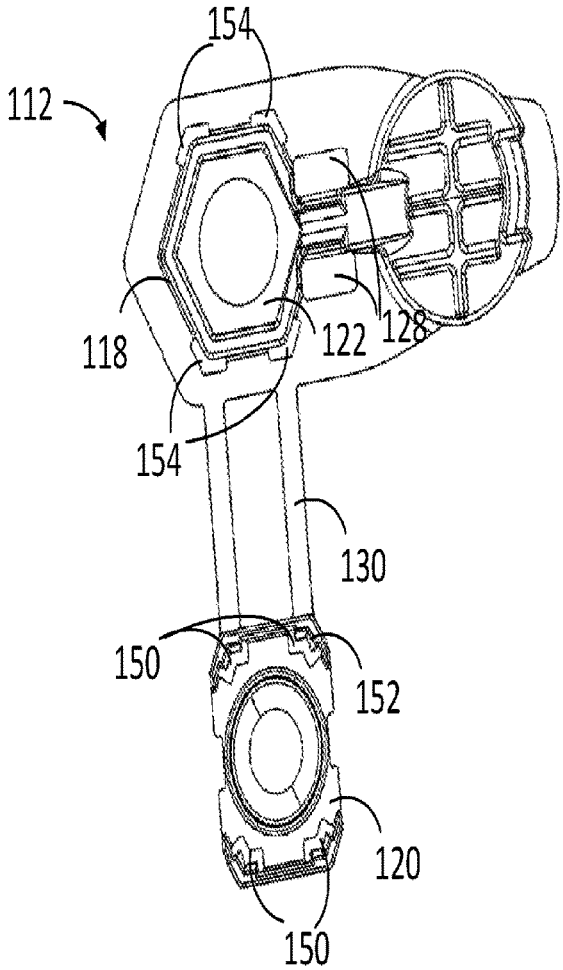
FIG. 3D is the rear view of the hardware retainer shown in FIG. 3A with the hardware retainer cover uncovered from the hardware retainer.
Figure 3A:
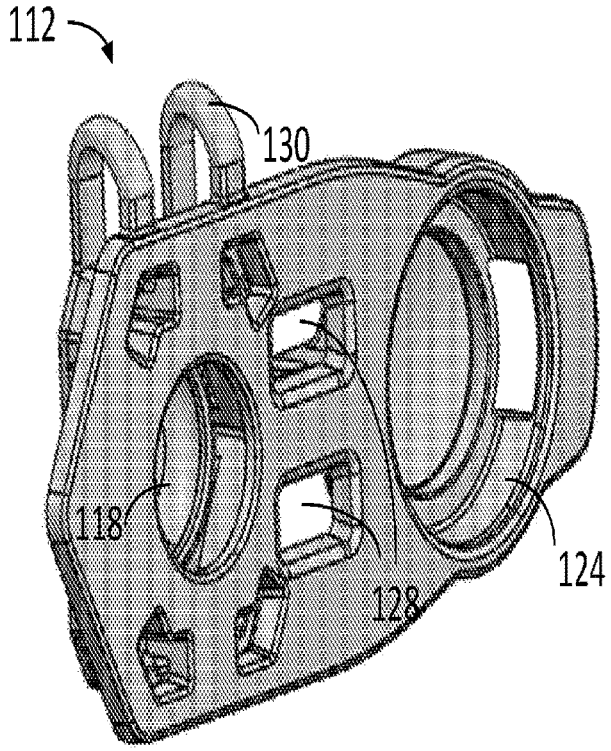
FIG. 3A is a front perspective view of a hardware retainer.
Figure 3B:
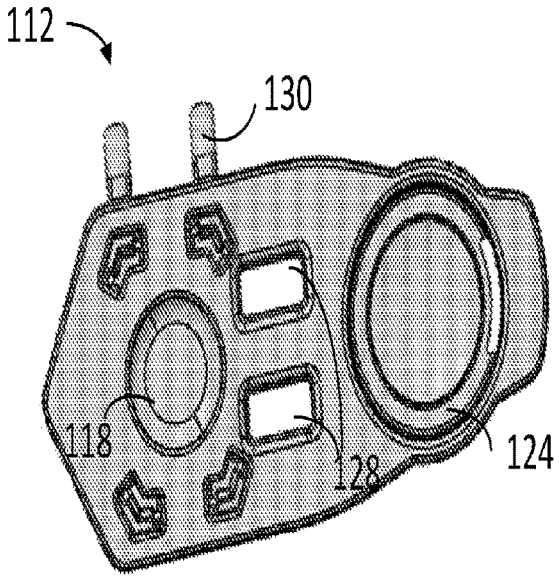
FIG. 3B is the front view of the hardware retainer shown in FIG. 3A.

The hardware retainer 112 illustrated in FIGS. 3A-3D comprises a hardware receiving aperture 118 and a hardware retainer cover 120. FIG. 3A is a front perspective view of a hardware retainer 112, FIG. 3B is a front view of the hardware retainer 112 shown in FIG. 3A, FIG. 3C is a rear view of the hardware retainer 112 shown in FIG. 3A and FIG. 3D is a rear view of the hardware retainer 112 shown in FIG. 3A with the hardware retainer cover 120 uncovered from the hardware retainer 112. The hardware retainer cover 120 can be coupled to the rear side of the hardware retainer. The hardware retainer cover 120 may be hingedly coupled to the hardware retainer 112, or be detachable. The hardware retainer cover 120 may comprise one or more hinges 130, where one end of the hinge 130 is attached to the hardware retainer 112 and the other end of the hinge 130 is attached to the hardware retainer cover 120. In some instances, the hardware retainer cover 120 may comprise one or more flaps 150 extending inward at its perimeter. The flaps 150 may comprise holes 152. The hardware receiving aperture 118 can have mating protrusions 154 along its perimeter. The hardware retainer cover 120 is configured to engage the hardware retainer 112 and cover the hardware receiving aperture 118 by the engagement of the protrusions 154 through the holes 152 with the flaps 150 (FIGS. 3C and 3D).

Figure 4A:
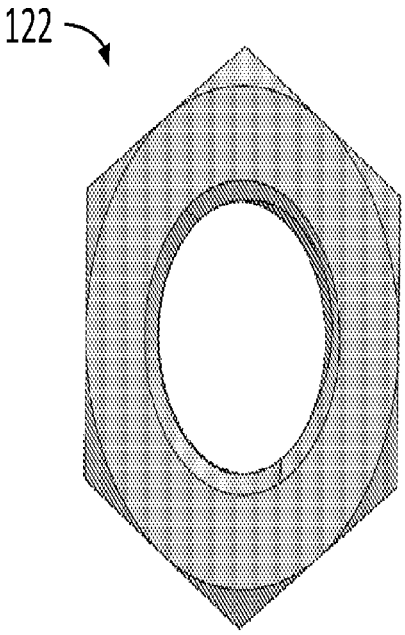
FIG. 4A is the front view of a nut.
Figure 4B:
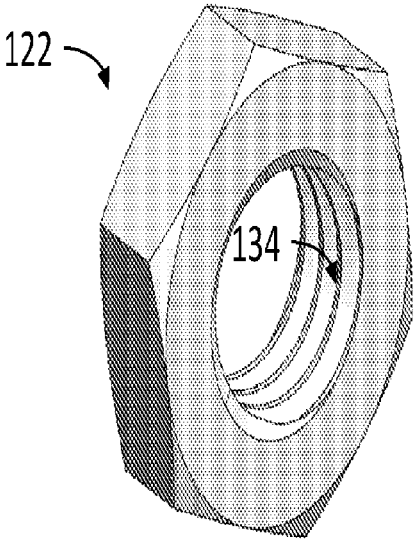
FIG. 4B is a front perspective view of the nut shown in FIG. 4A.
Figure 5A:
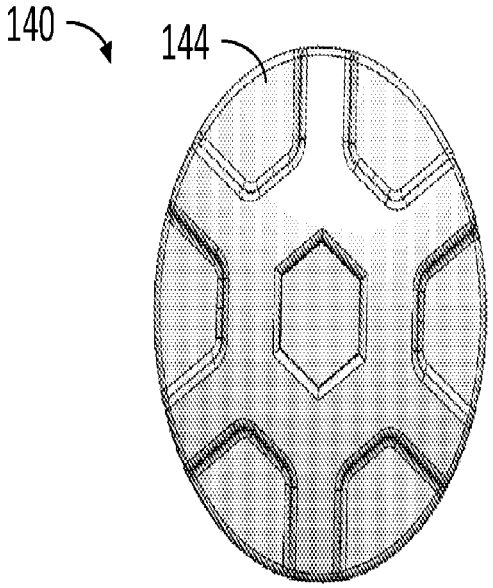
FIG. 5A is the front view of an accessory connector.
Figure 5B:
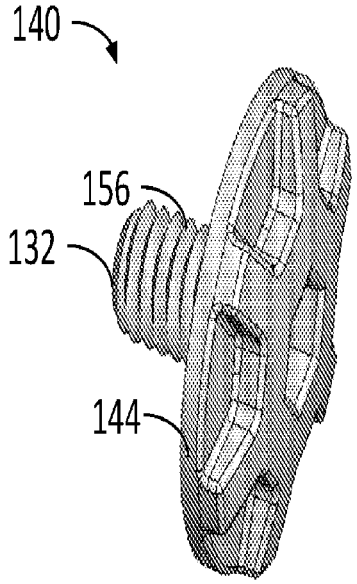
FIG. 5B is the front perspective view of the accessory connector shown in FIG. 5A.

A hardware retainer 112 may further comprise a nut 122, internally threaded with internal threads 134 (FIGS. 4A-4B). The nut 122 can be positioned in the hardware receiving aperture 118 and covered by the hardware retainer cover 120 (FIGS. 3C-3D). The hardware retainer 112 may include an anchor recess 124 (FIGS. 3A and 3B).

When the hardware retainer 112 in the embodiment of FIGS. 3C-3D is assembled with a bezel 110 (see FIG. 1B), the hardware retainer 112 can be positioned behind and coupled to the bezel 110 (FIG. 1B). The hardware receiving aperture 118 and the nut 122 may be aligned with the hardware opening 114 of the bezel 110. The anchor recess 124 of the hardware retainer 112 is aligned with the anchor opening 116 of the bezel 110. The hardware retainer 112 may be coupled to the bezel 110 by being snapped into the bezel 110. In some instances, the bezel 110 further comprises at least one prong 126 extending rearward of the bezel 110 adjacent the hardware opening 114 (FIG. 2B and the hardware retainer 112 further comprises at least one prong receiver 128 (FIGS. 3A-3D). The hardware retainer 112 can be snapped to the bezel 110 by the at least one prong 126 being received into the least one prong receiver 128.

The bezel and/or the bezel assembly may be constructed as separate parts and the parts may be assembled together through mechanisms such as being snapped, being glued, or other mechanisms know to a person skilled in the art. In some instances, the bezel and/or the bezel assembly may be constructed as one piece.

Besides reinforcing a vent opening, a bezel and/or a bezel assembly can be used to connect components of the helmet to the helmet body. Helmet components such as a fit system, a strap anchor, a comfort liner, or a multi-directional impact protection system may be attached to the helmet at the bezel through pins, magnets, glue, or any other mechanisms known to a person skilled in the art. The hardware retainer cover 120 may further comprise a connector for attaching a fit system, a strap anchor, a comfort liner, or a multi-directional impact protection system onto the helmet. The connector can also be configured to attach the components directly to the bezel. When attaching a helmet component to the helmet body, the bezel can be used alone or together with the hardware retainer, and the hardware opening of the bezel can be used alone or together with the anchor recess of the bezel.

Figure 6A:
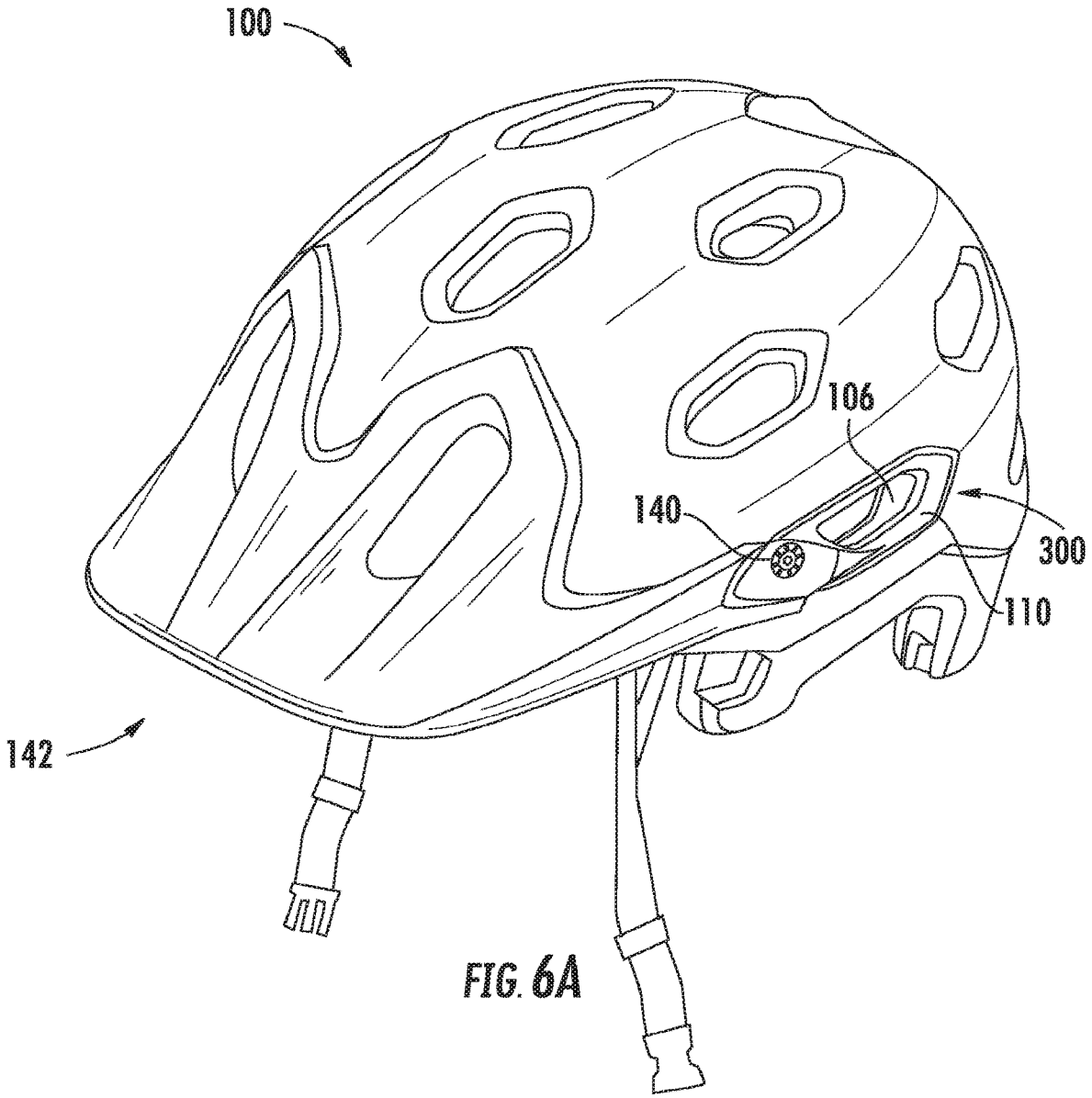
FIG. 6A is the front perspective view of an accessory being attached to a helmet through a bezel assembly and an accessory connector.
Figure 6B:
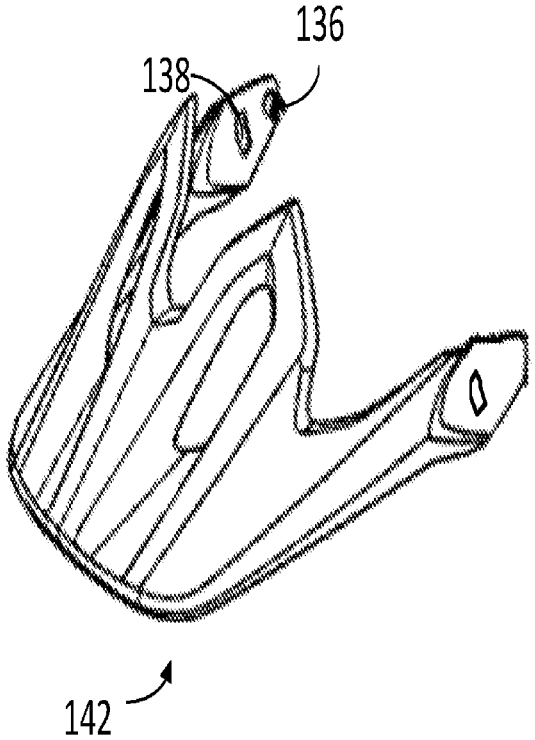
FIG. 6B shows the front perspective view of the accessory shown in FIG. 6A.

The bezel assembly and/or the bezel can also be used to attach an accessory to the helmet body. FIG. 6A shows the front perspective view of an example accessory 142 being attached to a helmet at one of the vent openings 106 through a bezel assembly 300 and an accessory connector 140. FIG. 6B shows a front perspective view of the example accessory 142 shown in FIG. 6A. In some instances, the nut 122 of the hardware retainer 112 is configured to receive and engage an accessory connector 140 therein. By example, an accessory connector 140 may be an accessory connector from one of at least a visor mechanism, a chin guard anchor, a light anchor, and an electronic accessory anchor. By example, it can also be used to connect accessories such as a visor, electronic accessories like cameras, chin guards, flash lights, and head lamps to the helmet.

An accessory connector 140 may comprise a threaded portion 132, which comprises external threads 156, and a cap 144. In the example of FIG. 6A, the accessory connector 140 engages the nut 122 through the external threads 156 of the accessory connector 140 being engaged with the internal threads 134 of the nut 122. To attach an accessory to the helmet, the accessory may comprise a slot 138 that allows the threaded portion 132 of the accessory connector 140 to pass through and allow the external threads 156 of the accessory connector 140 to engage the internal threads 134 of the nut 122 in the hardware retainer 112 (FIGS. 5A-6B). The slot 138 may be configured to define the range of adjustment for the accessory 142. The accessory connector 140 comprises a cap 144. The perimeter of the cap 144 can be larger than the perimeter of the slot 138 on the accessory 142 so that the cap 144 blocks the accessory 142 from disengaging from the helmet 100. The accessory 142 comprises a post 136 extending from the accessory 142. The post 136 can be inserted into the anchor opening 116 of the bezel 110 and further into the anchor recess 124 of the hardware retainer 112. In particular embodiments, the post 136 comprises a spring pin geometry that locks the post 136 in when inserted into the bezel 110 and the hardware retainer 112 (FIG. 6B). The post 136 can be used to limit the accessory 142 from rotating around the accessory connector 140 after the accessory 142 has been attached to the helmet 100. The post 136 can also provide an additional attachment point for the accessory 142 and strengthen the attachment of the accessory 142 to the helmet 100.

The attachment of an accessory to the helmet through the bezel through the engagement of internal and external threads is only an example of attaching an accessary to the helmet through the bezel. An accessory can be attached to the helmet through the bezel through mechanisms other than the engagement of the internal and external threads, such as the accessory connector can be snapped into the hardware opening, or the accessory can be attached to the bezel through pins, magnets, glue, or any other mechanisms known to a person skilled in the art. When attaching an accessory to the helmet, the bezel can be used alone or together with the hardware retainer, and the hardware opening of the bezel can be used alone or together with the anchor recess of the bezel.

The present disclosure is to be considered as an exemplification of the principles of the disclosed methods and systems. The presently-disclosed implementations are, therefore, to be considered in all respects as illustrative, and not intended to limit the broad aspect of the disclosed concepts to the embodiments illustrated.

Many additional components and manufacturing and assembly procedures known in the art or consistent with helmet manufacture are contemplated for use with particular implementations in this disclosure. For example, although particular implementations are disclosed, such implementations and implementing components may comprise any components, models, types, materials, versions, quantities, and/or the like as is known in the art for such systems and implementing components, consistent with the intended operation.

In places where the description above refers to particular implementations of protective helmets, it should be readily apparent that a number of modifications may be made without departing from the spirit thereof. All changes that come within the meaning of and range of equivalency of the description are intended to be embraced therein.

The word "exemplary," "example" or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented, but have been omitted for purposes of brevity.

The invention claimed is:

1. A helmet comprising:

a helmet body comprising an outer shell and an energy management layer inside the outer shell, the helmet body comprising a vent opening that extends through the outer shell and the energy management layer;

a helmet strap coupled to the helmet body;

a bezel separate from the outer shell and in-molded into the energy management layer, the bezel encircling the vent opening and having a hardware opening separate and offset from the vent opening and extending through the bezel and an anchor opening separate and offset from the vent opening and adjacent to the hardware opening; and a hardware retainer embedded in the energy management layer, and positioned behind and coupled to the bezel offset from the vent opening, the hardware retainer comprising a hardware receiving aperture aligned with the hardware opening, an internally threaded nut aligned with the hardware receiving aperture and the hardware opening, and a hardware retainer cover hingedly attached to the hardware retainer and configured to cover a rear side of the hardware receiving aperture, the hardware retainer further comprising an anchor recess aligned with the anchor opening.

2. The helmet of claim 1, further comprising an accessory connector coupled to the nut for connecting an accessory to the helmet.

3. The helmet of claim 2, wherein the accessory connector defines external threads for engaging the internal threads of the nut.

4. The helmet of claim 1, wherein the hardware retainer is coupled to the bezel by being snapped into the bezel.

5. The helmet of claim 4, wherein the bezel comprises at least one prong extending rearward of a rear surface of the bezel adjacent the hardware opening, the hardware retainer comprises at least one prong receiver, and the hardware retainer is snapped to the bezel by the at least one prong being received into the at least one prong receiver.

6. The helmet of claim 1, wherein the bezel further comprises a footing extending behind a rear surface of the bezel.

7. The helmet of claim 1, wherein at least one of the bezel and the hardware retainer is configured to attach one or more of a strap anchor, a fit system, a comfort liner, and a multi-directional impact protection system to the helmet body.

8. A helmet comprising: a helmet body comprising an outer shell and an energy management layer inside the outer shell, the helmet body comprising a vent opening that extends through the outer shell and the energy management layer;

a helmet strap coupled to the helmet body;

a bezel separate from the outer shell and in-molded into the energy management layer, the bezel encircling the vent opening and having a hardware opening separate and offset from the vent opening and extending through the bezel and an anchor opening separate and offset from the vent opening and adjacent to the hardware opening;

a hardware retainer embedded in the energy management layer, and positioned behind and coupled to the bezel offset from the vent opening, the hardware retainer comprising a hardware receiving aperture aligned with the hardware opening, an internally threaded nut aligned with the hardware receiving aperture and the hardware opening and configured to receive and engage an accessory connector therein, the hardware retainer further comprising an anchor recess aligned with the anchor opening;

an accessory comprising a post configured to be received in the anchor opening and a slot through the accessory adjacent to the post; and an accessory connector extending through the slot and coupling the accessory to the helmet.

9. The helmet of claim 8, wherein the accessory connector defines external threads for engaging the internal threads of the nut.

10. The helmet of claim 8, wherein the hardware retainer is coupled to the bezel by being snapped into the bezel.

11. The helmet of claim 10, wherein the bezel comprises at least one prong extending rearward of a rear surface of the bezel adjacent the hardware opening, the hardware retainer comprises at least one prong receiver, and the hardware retainer is snapped to the bezel by the at least one prong being received into the at least one prong receiver.

12. The helmet of claim 8, wherein the bezel further comprises a footing extending behind a rear surface of the bezel.

13. The helmet of claim 8, wherein at least one of the bezel and the hardware retainer is configured to attach one or more of a strap anchor, a fit system, a comfort liner, and a multi-directional impact protection system to the helmet body.

* * * * *